US011300370B2

(12) United States Patent
Migliaccio et al.

(10) Patent No.: US 11,300,370 B2
(45) Date of Patent: Apr. 12, 2022

(54) METHODS AND APPARATUS FOR DROPWISE EXCITATION HEAT TRANSFER

(71) Applicants: Christopher Phillip Migliaccio, University Park, MD (US); Nathan Scott Lazarus, Bethesda, MD (US)

(72) Inventors: Christopher Phillip Migliaccio, University Park, MD (US); Nathan Scott Lazarus, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 554 days.

(21) Appl. No.: 14/583,830

(22) Filed: Dec. 29, 2014

(65) Prior Publication Data

US 2016/0187068 A1 Jun. 30, 2016

(51) Int. Cl.
*F28F 13/04* (2006.01)

(52) U.S. Cl.
CPC ..... *F28F 13/04* (2013.01)

(58) Field of Classification Search
CPC .. F28F 13/00; F28F 13/10; F28F 13/18; F28F 13/04; F28G 7/00; F28D 15/00; F28D 15/02; F25D 21/00; F25D 21/04; F25D 2321/00; F25D 2321/14
USPC ..... 165/84, 109.1, 96; 62/259.2
See application file for complete search history.

(56) References Cited

U.S. PATENT DOCUMENTS 5,555,732 A * 9/1996 Whiticar ..... F24F 3/14 62/3.4
6,405,794 B1 * 6/2002 Kim ..... F28F 13/10 126/91 A
6,571,865 B1 6/2003 Shi et al.
6,745,590 B1 * 6/2004 Johnson ..... F25D 21/14 62/272
6,953,083 B2 * 10/2005 Kawakami ..... B01D 5/0012 165/114
7,686,071 B2 3/2010 Silverstein
7,726,138 B2 * 6/2010 Bailey ..... B01D 5/0009 62/121
8,865,297 B2 10/2014 Xiao et al.
(Continued)

FOREIGN PATENT DOCUMENTS

CN 102269539 A * 12/2011
JP 07174481 A * 7/1995
WO WO-2013026126 A1 * 2/2013 ..... C01B 5/00

OTHER PUBLICATIONS

Machine Translation CN102269539A (Year: 2011).*
(Continued)

*Primary Examiner* — Len Tran
*Assistant Examiner* — Gustavo Hincapie Serna
(74) *Attorney, Agent, or Firm* — Eric B. Compton

(57) ABSTRACT

A method and apparatus for heat transfer. In some embodiments, a heat transfer apparatus includes a body defining an inner volume; an inlet coupled to a vapor source; a coolant channel extending through the heat transfer apparatus; a condensing surface on which a vapor condenses, wherein the condensing surface is configured to cause the vapor to form as one or more drops on the condensing surface; and an actuator configured to excite the one or more drops at a resonant frequency of the one or more drops to remove the one or more drops from the condensing surface.

22 Claims, 3 Drawing Sheets

(56) References Cited

U.S. PATENT DOCUMENTS

2002/0079089 A1* 6/2002 Kang ..... B08B 7/026 165/84
2004/0093887 A1* 5/2004 Shyy ..... F04B 43/043 62/259.2
2006/0288709 A1* 12/2006 Reidy ..... F25B 21/02 62/3.4
2007/0089445 A1* 4/2007 Robinson ..... B01D 53/002 62/259.1
2007/0251249 A1* 11/2007 Burk ..... F02B 29/0462 62/121
2012/0048117 A1* 3/2012 Katzir ..... B01D 53/265 95/289
2012/0073320 A1* 3/2012 Seoane ..... F25B 39/024 62/291
2012/0145361 A1* 6/2012 Glezer ..... F28F 13/00 165/109.1
2015/0066161 A1* 3/2015 Iyad Al Dibs ..... B81B 7/008 700/20

OTHER PUBLICATIONS

Raben, I. A.; Commeford, G.; Dietert, R., "An investigation of the use of acoustic vibrations to improve heat transfer rates and reduce scaling in distillation units used for saline water conversion." U.S. Dep. Commerce, Off. Saline Water Res. Rep. No. 49, Mar. 1961.
Haughey, D. P., "Heat transfer during condensation on a vibrating tube." Trans. Instn.Chem. Engrs 1965, 43, 40.
Dent, J. C., "Effect of vibration on condensation heat transfer to a horizontal tube." Proc. Instn Mech. Engrs 1969, 184, 99-106.
Rose, J. W. "Dropwise condensation theory and experiment: a review." Proc. Inst. Mech. Eng. A 2002, 216, 115-128.
Daniel, S.; Chaudhury, M. K.; de Gennes, P.-G., "Vibration-actuated drop motion on surfaces for batch microfluidic processes." Langmuir 2005, 21, 4240-4248.
Dong, L.; Chaudhury, A.; Chaudhury, M. K., "Lateral vibration of a water drop and its motion on a vibrating surface." Eur. Phys. J. E 2006, 21, 231-242.
Brunet, P.; Eggers, J.; Deegan, R. D., "Vibration-induced climbing of drops." Phys. Rev. Lett. 2007, 99, 144501.
Noblin, X.; Kofman, R.; Celestini, F., "Ratchetlike motion of a shaken drop." Phys. Rev.Lett. 2009, 102, 194504.

* cited by examiner

METHODS AND APPARATUS FOR DROPWISE EXCITATION HEAT TRANSFER

GOVERNMENT INTEREST

Governmental Interest—The invention described herein may be manufactured, used and licensed by or for the U.S. Government.

RELATED APPLICATIONS

This application claims the benefit of U.S. Provisional Application No. 62/041,678 filed Aug. 26, 2014 which is herein incorporated by reference in its entirety.

FIELD OF USE

Embodiments of the present disclosure generally relate to heat transfer. More specifically, the present invention relates to excitation of the resonant frequency of condensate drops that have condensed on a surface and shedding those drops from the surface. In embodiments, the present disclosure may find use in environmental control, power generation, food processing, water treatment and other applications.

BACKGROUND

Vapor condensing on a surface usually takes the form of a continuous liquid film (i.e., filmwise condensation) or discrete liquid drops (i.e., dropwise condensation). Because the filmwise mode of condensation is not very efficient, the energy input to deliver vibrations may not justify the modest improvement in heat transfer. In dropwise condensation, the drop departs a vertical surface when its diameter exceeds its capillary length and gravitation forces overcome the capillary forces holding the drop to the vertical surface.

By avoiding the high thermal resistance associated with thick condensate films, dropwise condensation offers an order of magnitude greater heat transfer coefficients than filmwise condensation. However, despite the better performance offered by dropwise condensation, industrial processes typically use filmwise condensation because smooth, clean metals promote film wetting, whereas dropwise condensation usually requires a non-wetting surface. In embodiments using dropwise condensation as a drop departs the condenser surface, the condenser surface area in its wake is wiped allowing new, highly efficient drops to form.

Therefore there is a need in the art for incorporating improved heat transfer utilizing dropwise condensation in accordance with exemplary embodiments of the present invention.

BRIEF SUMMARY

Embodiments of the present invention relate to methods and apparatus for heat transfer. Embodiments of the present invention include a dropwise condensation method and apparatus for improved heat transfer. In some embodiments, a heat transfer apparatus includes a body defining an inner volume; an inlet coupled to a vapor source; a coolant channel extending through the heat transfer apparatus; a condensing surface on which a vapor condenses, wherein the condensing surface is configured to cause the vapor to form as a plurality of drops on the condensing surface; and an actuator configured to oscillate or vibrate the condensing surface at a frequency to excite and remove the plurality of drops from the condensing surface. In embodiments, the design increases the heat transfer of a dropwise condensation system by triggering the removal of condensate drops before they grow to the sized required for removal by gravity in a typical dropwise condenser. The higher performance offered by embodiments of this invention will reduce form factor, lower fuel usage and raise the efficiency of heat transfer systems.

In some embodiments a heat transfer method includes condensing a vapor on a condensing surface as one or more drops; cooling the condensing surface using a coolant; and exciting the one or more drops at a resonant frequency of the one or more drops to remove the one or more drops from the condensing surface.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention are directed to a method and apparatus for dropwise condensation heat transfer using condensate drop excitation.

Figure 1:
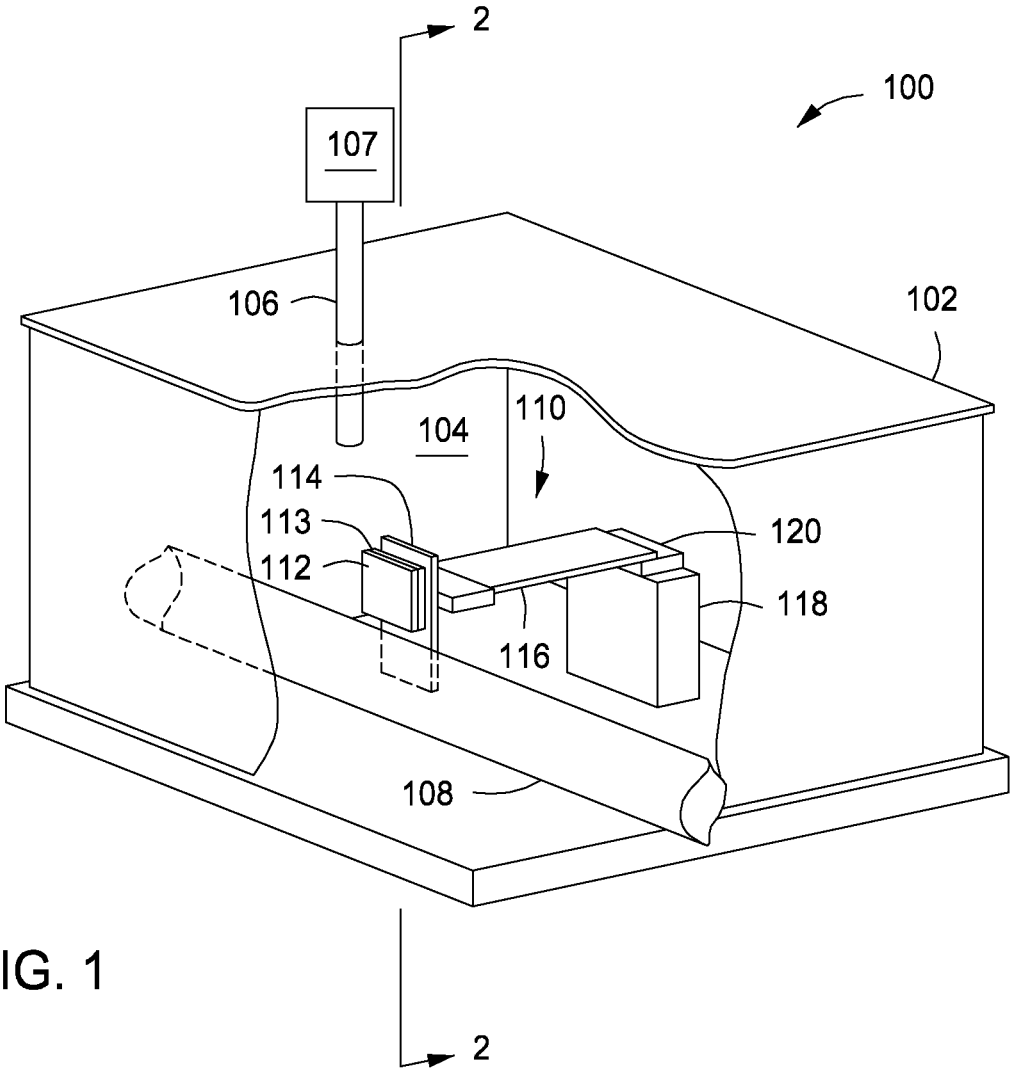
FIG. 1 is an illustration depicting a heat transfer apparatus in accordance with exemplary embodiments of the present invention.
Figure 2:
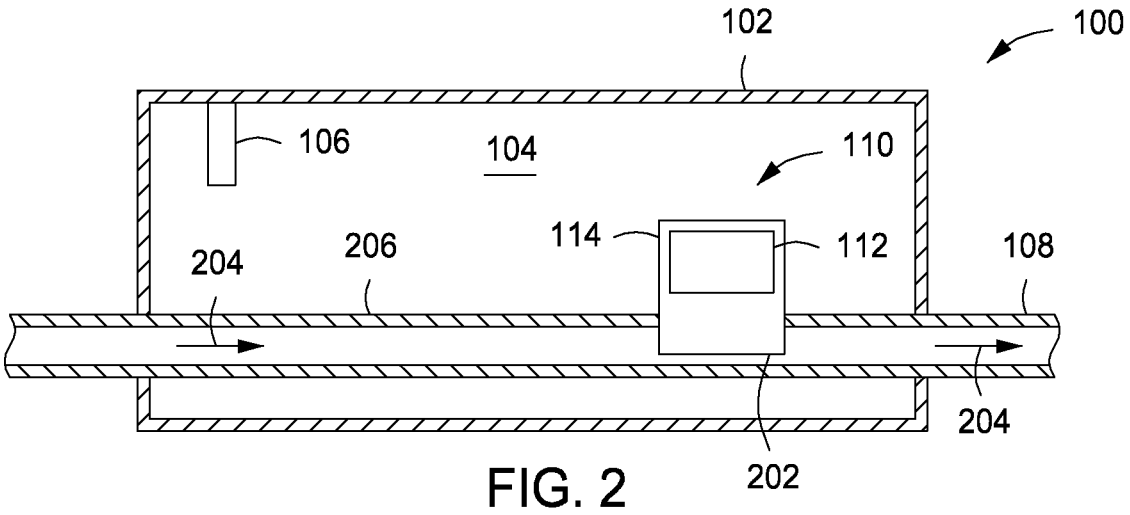
FIG. 2 is a cross-sectional view of the heat transfer apparatus of FIG. 1.

FIG. 1 illustrates a heat transfer apparatus 100 in accordance with some embodiments of the present invention. FIG. 2 illustrates a cross-sectional view taken along line 2-2 of the heat transfer apparatus 100. The heat transfer apparatus 100 includes a body 102 defining an interior volume 104, a vapor inlet 106, and a coolant channel 108. In some embodiments, the heat transfer apparatus 100 may include a vibration system 110 disposed in the interior volume 104. The vapor inlet 106 is coupled to a vapor source 107, which expels vapor to be condensed. For example, the vapor source 107 may be an outlet of a steam turbine in a thermal power plant. However, the vapor source 107 may include any apparatus that expels a vapor.

The vibration system 110 includes a condensing surface 112 coupled to a support member 114, a cantilever 116, and an actuator 120. In some embodiments, a thermo electric cooler (TEC) 113 may be disposed between the condensing surface 112 and the support member 114. When a voltage is applies to the TEC, a temperature gradient occurs across the thermoelectric material, causing one side to be hot and the other side to be cold. The TEC 113 is coupled to the condensing surface 112 on the cold side and to the support member 114 on the hot side. The support member 114 and the actuator 120 are coupled to opposite ends of the cantilever 116. The actuator 120 is supported on a base 118. The actuator 120 may be any type of actuator capable of vibrating at different frequencies.

The condensing surface 112 provides a cooled surface on which hot vapor entering the interior volume 104 condenses. Referring to FIG. 2, a lower portion 202 of the support member 114 extends into the coolant channel 108. Coolant flows through the coolant channel 108 past the lower portion 202 as indicated by arrows 204, and continuously cools the support member 114. Because the hot side of the TEC 113 is coupled to the support member 114, heat is transferred from the condensing surface 112, through the TEC 113, and to the support member 114. Thus, by cooling the support member 114, the heat absorbed at the condensing surface 112 is dissipated. In some embodiments, the condensing surface 112 may alternatively be cooled by other methods such as, for example, conduction, free and forced convection, and radiation. In such embodiments, the coolant channel 108 would not be necessary.

Typically, vapor entering the heat transfer apparatus 100 would condense on the condensing surface 112 as a continuous condensate film (filmwise condensation). To promote dropwise condensation, the inventors have formed the condensing surface 112 of a hydrophobic material. A hydrophobic material results in a contact angle (θ) between the drop and the condensing surface 112 to be greater than 90° (i.e., non-wetting). In some embodiments, the condensing surface 112 is coated with the hydrophobic material. The hydrophobic material may include any material that provides a contact angle greater than 90°. In some embodiments, for example, the hydrophobic material may include TEFLON®. In some embodiments, the condensing surface 112 may alternatively be made of a material that is not hydrophobic, but still promotes condensation on the surface in discrete drops. For example, the condensing surface 112 may be a lubricant-impregnated surface that promotes the condensation of the vapor as discrete drops.

As explained above, in dropwise condensation, drops formed on a stationary condensing surface grow and sometimes coalesce with other nearby drops to form larger drops. Because of their high thermal resistivity, the large drops create a thermal barrier between the vapor and the cooled surface, thereby decreasing the efficiency of the heat transfer apparatus. Drop departure is initiated when the diameter of a drop exceeds the capillary length of the liquid (e.g., about 2.7 mm for water) and gravitational forces overcome the capillary forces holding the drop to the condensing surface 112.

For stationary cases, the critical departure radii of drops growing on stationary vertical surface for a range of θ and hysteresis ($\theta_a$-$\theta_r$), where $\theta_a$ is the advancing contact angle and $\theta_r$ is the receding contact angle, in terms of the Bond number ($B_d$) is determined by $$B_d = \frac{\Delta\rho g}{\gamma}\left[\left(\frac{2-\cos\theta+\cos^3\theta}{12}\right)^{1/3} r_{max}\right] \tag{1}$$

where Δp is the density difference between the liquid and vapor phases, γ is surface tension, and g is gravitational acceleration. The argument in brackets is the radius of a spherical drop with volume equal to the volume of the critically-sized spherical cap drop of radius $r_{max}$. Solving the optimization problem yields the maximum Bond number and hence the maximum radius ($r_{max}$) at which drop departure will commence for a given contact angle hysteresis.

The inventors have discovered that exciting the condensate drops at their resonance modes improves efficiency by advantageously causing the drops to depart from the condensing surface 112 before they coalesce and form larger drops. For a liquid drop on a vibrating surface, the first resonance mode (known as the "rocking mode") is related to the oscillation of the drop's center of mass and is inversely related to the mass of the drop (1/mass). The natural frequency of the drop is therefore also related to the mass of the drop (1/√m). Sufficient vibrational amplitude deforms the drop such that contact angle hysteresis pinning the drop to the surface is overcome and the drop may move across or off the condensing surface 112. Resonance-induced drop mobilization enhances condensate shedding and leads to less condensing surface area wasted on large, thermally inefficient drops.

For vibrating cases, resonance modes of the drops mobilize the drops before the maximum radius observed for the stationary case is reached. The lowest radii peaks for each vibrating case correspond to the rocking mode. The rocking mode frequency $\omega_0$ of a liquid drop is determined by $$\omega_0 = \sqrt{\frac{6\gamma h(\theta)}{\rho(1-\cos\theta)(2+\cos\theta)}}\cdot r^{-3/2} \tag{2}$$

where h(θ) is a numerically computer factor accounting for drop deformation. The radius (r) of the drop at the time of departure is determined from Equation (2) noting that the $\omega_0=2\pi\nu$, where v is the excitation frequency in hertz.

As a drop is resonated, it moves off of the condensing surface 112 and wipes away other drops in its path, leaving behind a refreshed area (depicted in FIG. 3) on which more condensate drops can form. Because the drops are moved off of the condensing surface 112 more quickly than in the stationary case, thereby allowing more vapor to condense on the surface, heat transfer is improved.

Figure 3:
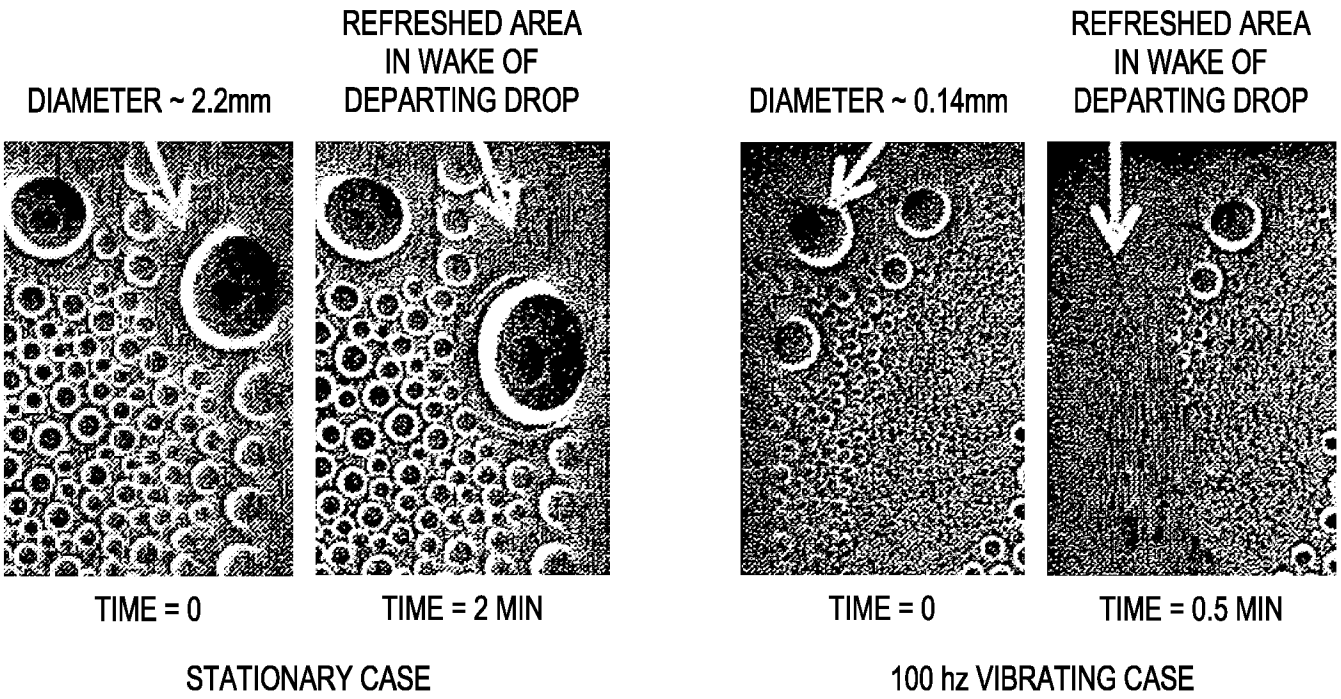
FIG. 3 illustrates several examples of images of dropwise condensation on stationary and vibrating surfaces in accordance with exemplary embodiments of the present invention.
Figure 4:
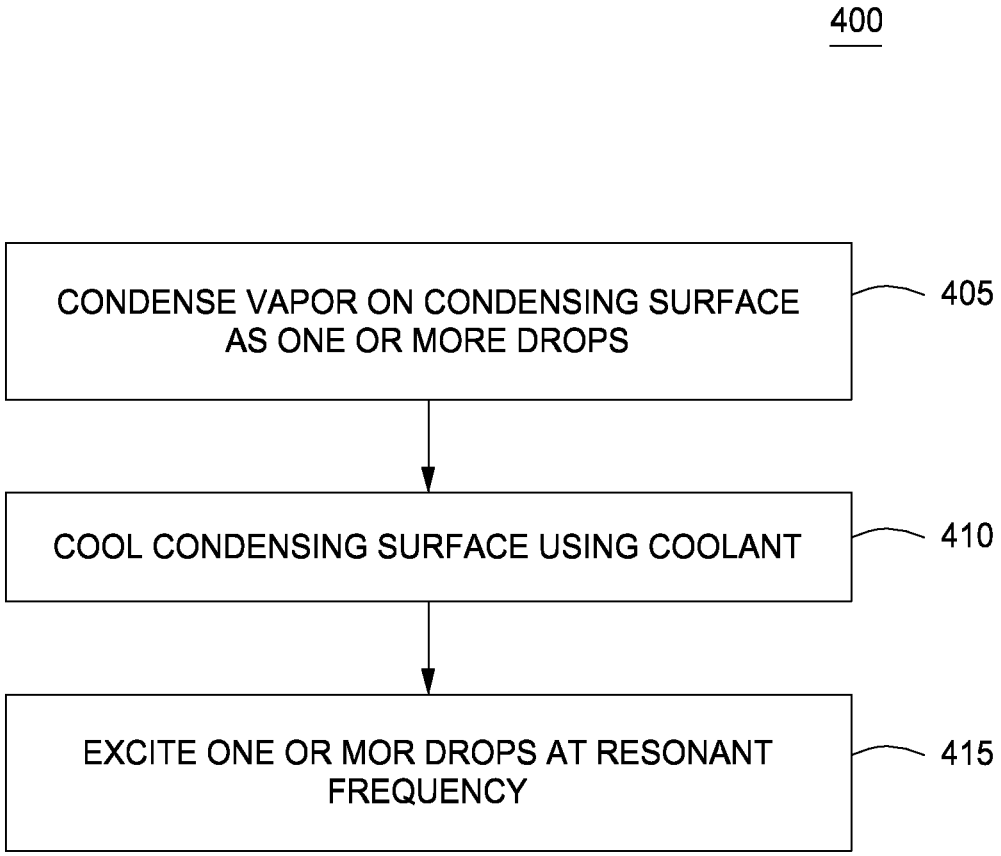
FIG. 4 is a flowchart illustrating a heat transfer method in accordance with exemplary embodiments of the present invention.

FIG. 3 depicts condensate drops that form on the condensing surface 112 in the stationary case and in a case in which the drops are excited at a frequency of 100 Hz. As illustrated on the left side of FIG. 3, it takes significantly about 2 minutes for a drop to move off of the condensing surface 112 because smaller drops must first coalesce into large drops to overcome the capillary forces holding the drops to the condensing surface 112. As the drops coalesce and form a large drop, the gravitational force on the drop increases, until, finally, the gravitational force overcomes the capillary forces holding the drop to the surface. As the large drop moves off of the surface, it leaves behind a refreshed area. However, when the condensing surface 112 is excited at a frequency of 100 Hz (right side of FIG. 3), smaller drops are moved off of the condensing surface 112 more quickly (about 0.5 minutes). Because excited drops mobilize and shed from the condensing surface 112 with greater frequency than with the stationary case, a larger refreshed area results.

Returning to FIG. 1, in some embodiments, the actuator 120 may be a mechanical actuator that vibrates at a predetermined frequency. The vibrations are transmitted from the actuator 120 to the support member 114 and condensing surface 112 via the cantilever 116. The actuator 120 is capable of operating at a various range of frequencies and is set to operate at the resonant frequency of the drops. In some embodiments, the actuator 120 may be a piezoelectric actuator. In such an embodiment, the cantilever 116 is the piezoelectric member and the actuator 120 is a power source that applies a voltage to the piezoelectric member to vibrate it at a given frequency.

Although the above description has been made with respect to a mechanical actuator, the actuator 120 may be any other type of actuator capable of resonating the condensate drops on the condensing surface 112. For example, in some embodiments, the actuator 120 may be an electric actuator that applies an electric current matching the resonant frequency of the drops. In another embodiment, the actuator 120 may be an acoustic actuator that effectuates changes in a pressure in the heat transfer apparatus causing the drops to resonate. The actuator 120 may alternatively be magnetic, optical, or thermal. In such embodiments, it is not necessary for the actuator 120 to be coupled to the condensing surface 112.

Although the condensing surface 112 is depicted in FIG. 1 as a dedicated surface on which vapor condenses, in some embodiments the condensing surface 112 may alternatively be an outer surface 206 of the coolant channel 108. In such an embodiment, a heat transfer system (not shown) that includes the heat transfer apparatus 100 may be designed to operate at a frequency equal to the resonant frequency of the condensed drops. For example, vibrations inherent to such a system may be tuned to the desired excitation frequency (e.g., using dampers and similar devices). The actuator 120 in such an embodiment would be a motor (not shown) that drives the heat transfer system.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated. While the foregoing is directed to embodiments of the present invention, other and further embodiments of the invention may be devised without departing from the basic scope thereof, and the scope thereof is determined by the claims that follow.

The invention claimed is:

1. A heat transfer apparatus, comprising:

a closed body defining an inner volume;

an inlet coupled to a vapor source; wherein the vapor source is not ambient air, a vertical condensing surface on which a vapor condenses, wherein the condensing surface is configured to cause the vapor to form as one or more drops on the condensing surface; and an actuator inside the body coupled to the condensing surface which vibrates the condensing surface, wherein the actuator is set to vibrate at an excitation frequency equal to a resonant frequency of the drops to keep the one or more drops from reaching the size in which gravitational forces overcome the capillary forces holding the drops to the condensing surface and so that drops move off the condensing surface in a downward direction wiping away other drops in their path leaving behind a refreshed area resulting in an improvement in heat transfer over an un-excited dropwise condensation system.

2. A heat transfer apparatus, comprising:

a body defining an inner volume;

an inlet coupled to a vapor source;

a condensing surface on which a vapor condenses, wherein the condensing surface is configured to cause the vapor to form as one or more drops on the condensing surface;

an actuator proximate to the condensing surface configured to vibrate drops on the condensing surface;

a base, wherein the actuator is disposed atop the base;

a cantilever coupled to the actuator at a first end;

a support member coupled to a second end of the cantilever;

the condensing surface coupled to the support member, wherein a lower portion of the support member extends into a coolant channel; and wherein the one or more drops are removed by operation of the actuator at an excitation frequency of the drops before the one or more drops reaching the size required for removal by gravity resulting in an improvement in heat transfer over an un-excited dropwise condensation system; and wherein the excitation frequency by the actuator is equal to a resonant frequency of each of the one or more drops.

3. The heat transfer apparatus of claim 1, wherein the condensing surface is an outer surface of the coolant channel.

4. The heat transfer apparatus of claim 1, wherein the excitation frequency ranges from above zero (0) to five hundred (500) Hertz.

5. The heat transfer apparatus of claim 1, wherein the excitation frequency ranges from above zero (0) to two hundred (200) Hertz.

6. The heat transfer apparatus of claim 1, wherein the excitation frequency ranges from fifty (50) to one hundred fifty (150) Hertz.

7. A heat transfer method comprising:

condensing a vapor as one or more drops on a vertical condensing surface located inside a closed body; wherein an inlet is coupled to a vapor source, and wherein the vapor source is not ambient air;

cooling the condensing surface using a coolant; and using an actuator inside the body coupled to the condensing surface to vibrate the condensing surface, wherein the actuator is set to vibrate at an excitation frequency equal to a resonant frequency of the drops to keep the one or more drops from reaching the size in which gravitational forces overcome the capillary forces holding the drops to the condensing surface and so that drops move off the condensing surface in a downward direction wiping away other drops in their path leaving behind a refreshed area resulting in an improvement in heat transfer over an un-excited dropwise condensation system.

8. The heat transfer apparatus of claim 1, wherein the actuator comprises a mechanical, electric, or magnetic actuator.

9. The heat transfer apparatus of claim 1, wherein the actuator is set to vibrate at the rocking mode frequency of the drop.

10. The heat transfer apparatus of claim 1, wherein the condensing surface comprises a hydrophobic coating.

11. The heat transfer apparatus of claim 1, wherein the condensing surface is a lubricant-impregnated surface.

12. The heat transfer apparatus of claim 2, wherein the condensing surface is vertical.

13. The heat transfer apparatus of claim 1, wherein the drops comprise water and do not reach a size in excess of 2.7 mm in diameter.

14. The heat transfer apparatus of claim 1, further comprising a thermo-electric cooler positioned proximate to the condensing surface that is configured to provide cooling at the condensing surface.

15. The heat transfer apparatus of claim 1, wherein vibrations are transmitted from the actuator to the condensing surface via a cantilever.

16. The heat transfer apparatus of claim 1, wherein the vertical condensing surface is flat.

17. The heat transfer apparatus of claim 1, wherein the condensing surface is configured to cause the vapor to form as one or more drops on the entire surface area of the condensing surface.

18. The heat transfer apparatus of claim 9, wherein the rocking mode frequency $\omega_0$ of the one or more liquid drops is determined as follow:

$$\omega_0 = \sqrt{\frac{6\gamma h(\theta)}{\rho(1-\cos\theta)(2+\cos\theta)}} \bullet r^{-3/2},$$

where $\theta$ is a contact angle between the drop and the condensing surface, $\rho$ is the density of the liquid, $\gamma$ is surface tension of the drop on the condensing surface, $h(\theta)$ is a factor accounting for drop deformation, and r is the radius of the drop at the time of departure.

19. The heat transfer apparatus of claim 1, wherein droplets move off the condensing surface in only a vertical direction.

20. The heat transfer apparatus of claim 1, wherein the vertical condensing surface includes no horizontal surface upon which droplets or portions thereof condense and/or form.

21. The heat transfer apparatus of claim 1, wherein the vertical condensing surface includes no protrusions and/or indentations.

22. The heat transfer apparatus of claim 17, wherein the only surface of the condensing surface where droplets condense and/or form lies entirely on the same vertically-oriented plane.

* * * * *